US006035798A

United States Patent [19]

Johnson

[11] Patent Number: 6,035,798

[45] Date of Patent: Mar. 14, 2000

[54] MARINE ANCHOR

[76] Inventor: Mark E. Johnson, Rte. 2 Box 554B, Cheraw, S.C. 29520

[21] Appl. No.: 09/336,590

[22] Filed: Jun. 21, 1999

Related U.S. Application Data

[60] Provisional application No. 60/092,561, Jul. 13, 1998.

[51] Int. Cl.[7] ..... B63B 21/46

[52] U.S. Cl. ..... 114/299; 114/301

[58] Field of Search ..... 114/294, 297, 114/299, 301

[56] References Cited

U.S. PATENT DOCUMENTS

| | | | |
|---|---|---|---|
| 180,374 | 7/1876 | Robinson . | |
| 2,365,136 | 12/1944 | Behrens . | |
| 2,424,040 | 7/1947 | Long | 114/299 |
| 2,956,529 | 10/1960 | Samalion . | |
| 3,404,652 | 10/1968 | Gardy . | |
| 4,403,564 | 9/1983 | Garvin . | |
| 4,951,593 | 8/1990 | Brown et al. . | |
| 5,353,731 | 10/1994 | Richter . | |
| 5,622,135 | 4/1997 | Eberline Sr. . | |

FOREIGN PATENT DOCUMENTS

| | | |
|---|---|---|
| 3730-483 | 4/1989 | Germany . |
| 485605 | 10/1953 | Italy . |
| 77875 | 1/1951 | Norway . |

*Primary Examiner*—Stephen Avila
*Attorney, Agent, or Firm*—Richard C. Litman

[57] ABSTRACT

A marine anchor for recreational boats comprising a rotating hub, with a plurality of flukes extending outward, and a substantially right-angle shaped bail member including five bail positions for receiving a slidable shackle of an anchor chain. The first bail to shakle position is the anchored position. The second bail to shackle position allows for a conventional retrieval of the anchor from above the location of the set anchor. An alternate retrieval can result in a third bail to shackle position from an anchored boat position further away from the set anchor. In the second and third positions the flukes are free to rotate enabling the marine anchor to be retrieved. A fourth position of the bail to shackle position is pulling the anchor chain and shackle from the opposite end of the anchor. A fifth position of the bail is a resting position on the bed of the sea floor by releasing the tension of the anchor chain such as during a slack tide to minimize entanglement with other loose anchors or debris.

6 Claims, 3 Drawing Sheets

MARINE ANCHOR

CROSS-REFERENCE TO RELATED APPLICATION

This application claims the benefit of U.S. Provisional Patent application Ser. No. 60/092,561, filed Jul. 13, 1998.

BACKGROUND OF THE INVENTION

1. Field of the Invention

The present invention relates to a marine anchor for recreational boating. More particularly, the present invention relates to a marine anchor having a rotating hub, with flukes extending outward, and a slidable shackle.

2. Description of Related Art

Although marine anchors for recreational boats come in many shapes and sizes, two predominant categories stand out as follows: (1) anchors with flukes positioned in a circular manner about a common shank; and (2) anchors where the base portions of a pair of flukes are pivotally mounted to a common shank. Both categories of anchors may be fitted with a sliding shank mechanism that allows for easy retrieval if the anchor becomes fouled by a snag.

The art related to circular fluke patterned anchors includes anchors with a solid mushroom or disc shaped fluke assembly and anchors with a plurality of flat or rod-shaped flukes. Representative examples of circular fluke patterned anchors are shown in U.S. Pat. No. 2,365,136 issued to Behrens on Dec. 23, 1942; U.S. Pat. No. 4,403,564 issued to Garvin on Sep. 13, 1983; U.S. Pat. No. 5,353,731 issued to Richter on Oct. 11, 1994; Italian Patent No. 485,605 issued on Oct. 16, 1953, and Norwegian Patent No. 77,875 issued on Jan. 2, 1951.

The Richter anchor has a fixed cylindrical hub made from solid steel with several radially extending rod-like flukes. The rod-like flukes extend from the hub at a 60° angle. In addition, a steel rod handle is provided which initially extends axially from the upper surface of the hub and then bends back around the hub where it is connected to the lower surface of the hub. This handle shape produces upper and lower bail sections where the shackle, connected to the anchor line or chain, is slidable between the bail sections depending on whether the anchor is being retrieved or set.

The pattern of the Garvin anchor consists of a plurality of flat flukes bent at an angle at each end to form imbedding and holding portions. The flukes are rotatably mounted on a shaft, in tandem, as the crown of the anchor. This type of mounting allows the flukes to be positioned separately from each other, about the shaft to form various patterns depending on the needs of the user. The bail of the anchor is formed from a single slender bar shaped to describe two bail positions, one for setting and one for dislodging the anchor.

Norwegian Patent No. 77,875 appears to show an anchor crown, shaped like a grappling hook, attached to a shaft. A bail structure is pivotally mounted at both ends of the shaft. The bail is shaped to form two bail positions where the anchor's shackle is slidable between the bail positions depending on whether the anchor is being retrieved or set.

The art of interest related to pivoting paired-fluke anchors includes anchors with various mechanisms for easy retrieval involving pivoting shank sections, loop or pocket shanks, pivoting bail sections, and multiple bail position members. Representative examples of paired-fluke anchors are shown in U.S. Pat. No. 180,374 issued to Robinson on Jul. 25, 1876; U.S. Pat. No. 2,956,529 issued to Samalion on Feb. 26, 1958; U.S. Pat. No. 3,404,652 issued to Gardy on Apr. 21, 1967; U.S. Pat. No. 4,951,593 issued to Brown et al. on Aug. 28, 1990; U.S. Pat. No. 5,622,135 issued to Eberline, Sr. on Apr. 22, 1997; and German Pat. No. 3,730,483 issued Jun. 4, 1989.

The Gardy anchor utilizes a multiple shear pin assembly to position the angle of the fluke pivot for setting the anchor in the bed of a body of water. If the anchor fouls upon retrieval, force may be applied to the anchor chain from an above position to break the shear pin(s) to release the fouled flukes.

A two piece shank assembly is used in the Brown et al. anchor. The two piece shank assembly releasably retains a single central shank tube within which the anchor line passes for attachment to the main fluke shaft. If the flukes become fouled by an underwater obstruction, the central shank tube may be detached, by an upward force, from the two piece shank assembly and rotated about the main fluke shaft to allow the anchor to be pulled clear of the obstruction.

The Eberline, Sr. anchor includes an anchor line sliding shackle. When the anchor is retrieved, the shackle slides towards the pivoting flukes to a position behind their point of entry into the bed. This sliding movement produces a force with a substantial upward component behind this entry point to withdraw the flukes from the bed.

It is seen that most recreational boat anchors, including those mentioned above, require the disengagement force to be applied from above, in close proximity to the position of the set anchor. While the present invention can also be released in this fashion, the height and shape of the bail member allows the present anchor to release at a point where the boat is a substantial distance from the location of the set anchor. This advantageous situation occurs because the flukes are basically pried from the bed by the force applied at the upper bail position instead of being pulled out from above.

Accordingly, none of the above inventions and patents, taken either singly or in combination, is seen to describe the instant invention as claimed.

SUMMARY OF THE INVENTION

The present invention, generally stated, provides a novel configuration for a marine anchor such that it allows for easy disengagement from the bed of body of water and reduced effort in pulling the anchor into the boat.

Briefly described, the preferred embodiment of this invention comprises a cylindrical hub rotatably mounted on an elongated shank having a first and second end; a bail member, having two bail positions, permanently fitted to the elongated shank; and a plurality of flukes evenly spaced about the axis of the hub and extending outward from the hub, towards the first end of the elongated shank, at an acute angle.

The bail member is substantially C-shaped to form a first bail position and a second bail position. The first bail position is used when the anchor is set into the bed of a body of water. The second bail position allows for either a conventional retrieval from above the location of the set anchor or an alternate retrieval from a position farther away from the set anchor.

The overall length of the bail member is such that when fixed to the elongated shank, the flukes remain free to fully rotate about the longitudinal axis of the elongated shank. For example, the bail member is free to rotate to a resting position on the surface of the bed of the body of water. In addition, because the flukes are free to rotate about the longitudinal axis of the elongated shank, the marine anchor can be easily retrieved along the bed of the body of water. In this manner, the ends of the flukes freely rotate like a wheel, where the shackle, attaching the anchor chain and line, is in the second bail position and the longitudinal axis of the elongated shank is substantially perpendicular to the anchor line during retrieval.

It is therefore one object of this invention to provide a marine anchor that can be retrieved from a variety of positions both above and away from the location of the anchor when set in the bed of a body of water.

It is another important object of this invention provide a marine anchor capable of easy retrieval along the surface of the bed of a body of water.

It is an object of this invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
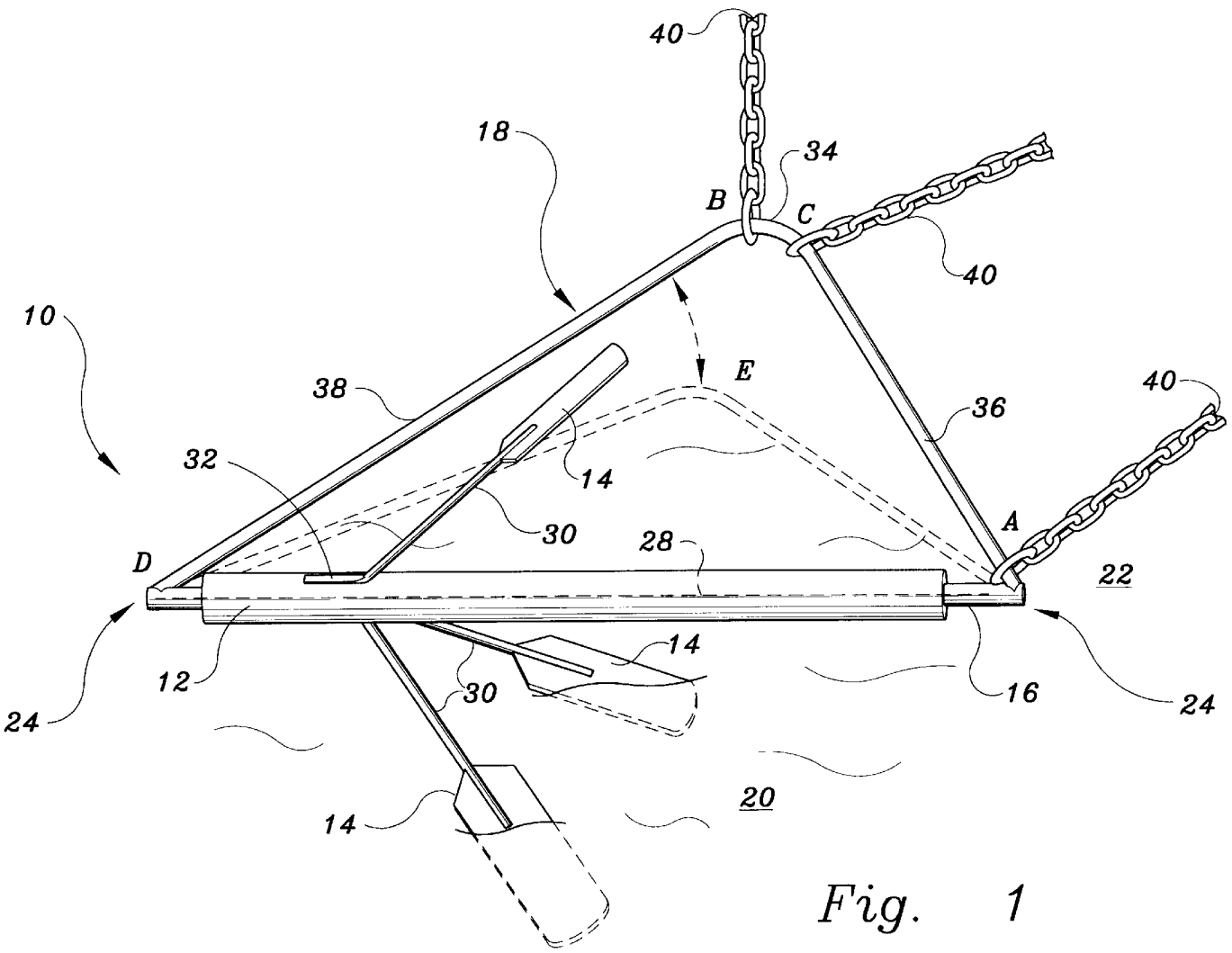
FIG. 1 is an environmental, perspective view of a marine anchor according to the present invention.
Figure 2:
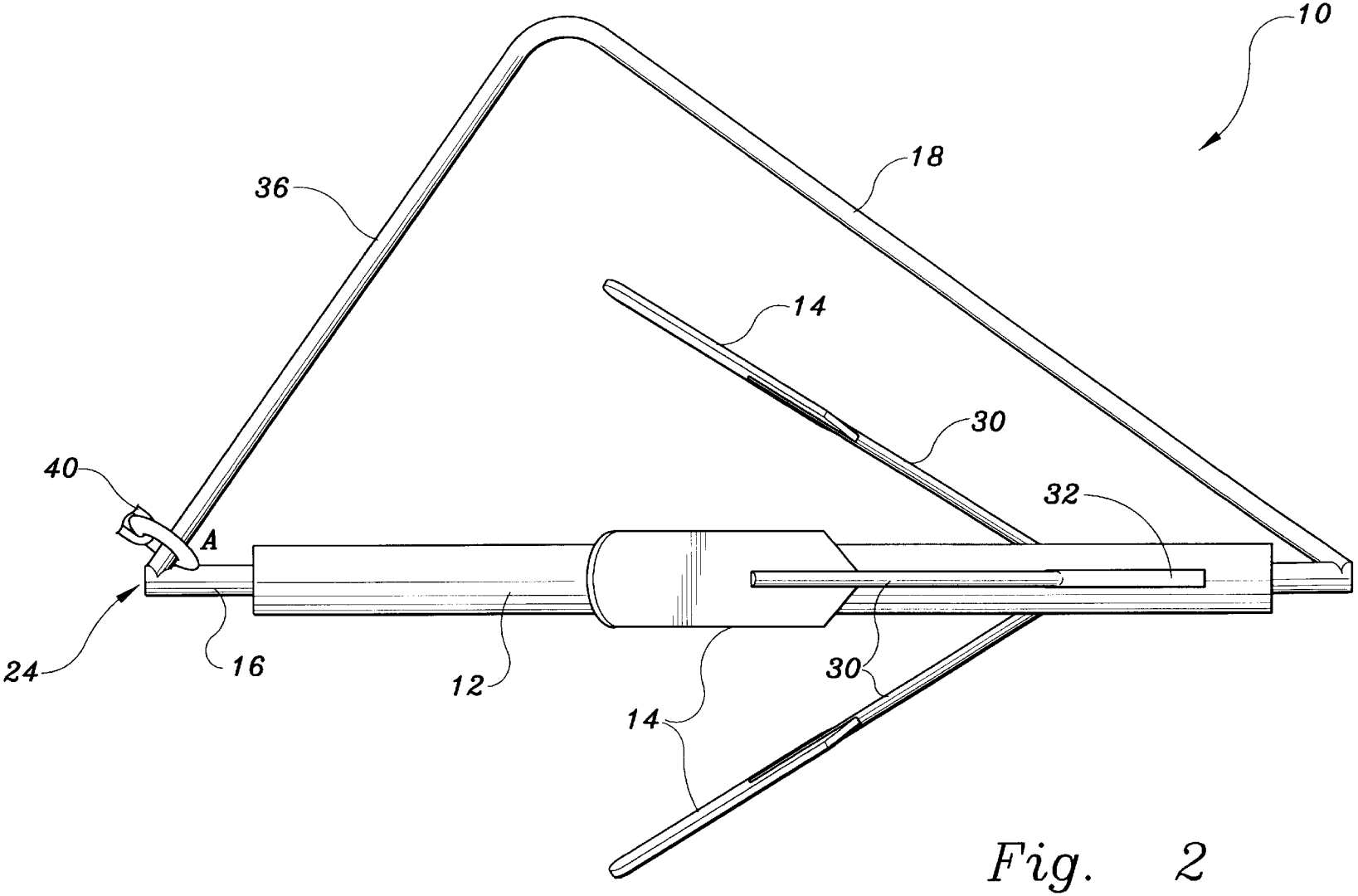
FIG. 2 is a right side elevational view of the marine anchor of FIG. 1.
Figure 3:
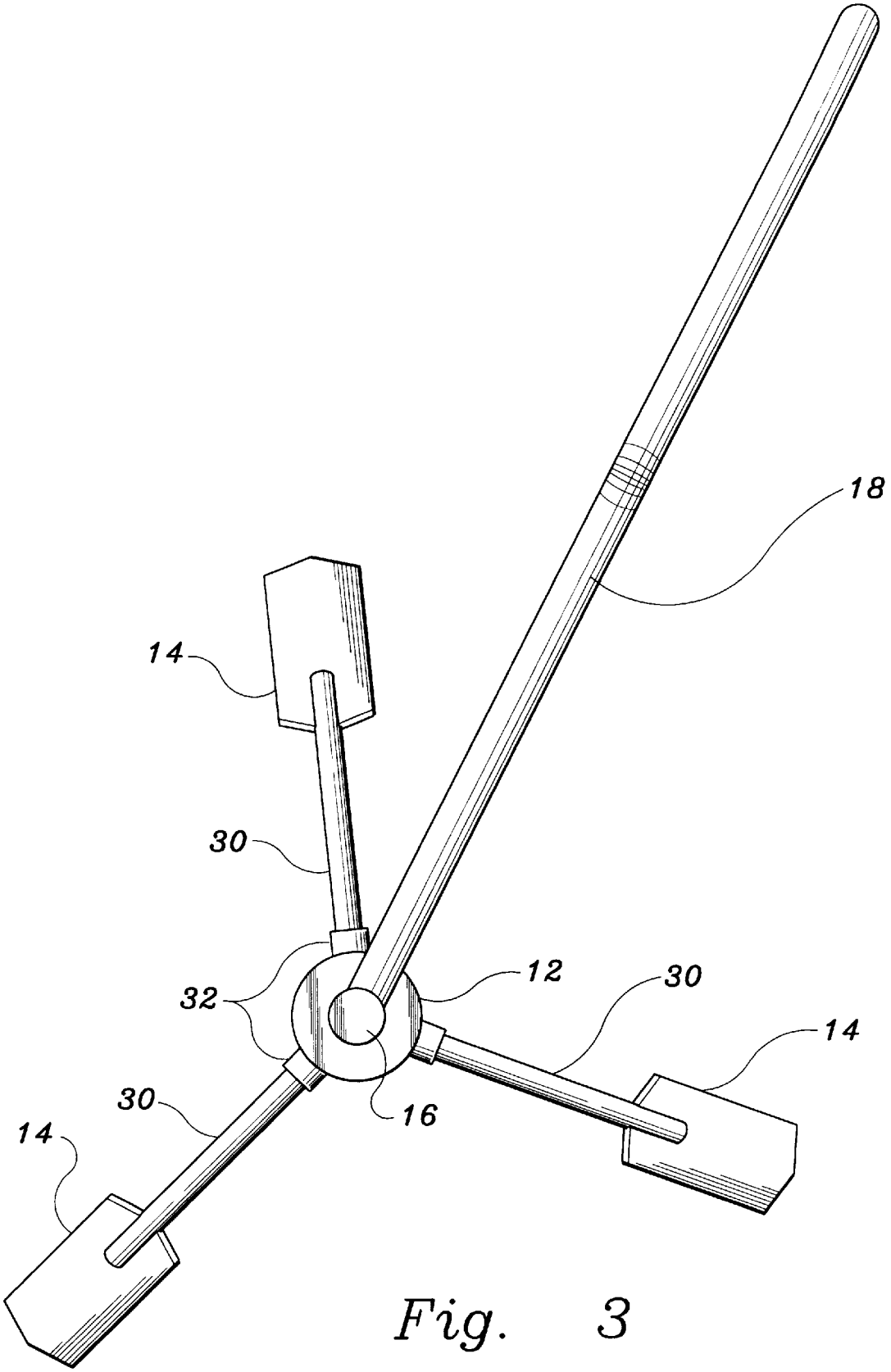
FIG. 3 is a front elevational view of the marine anchor of FIG. 1.

In FIGS. 1 to 3, the marine anchor 10 comprises a hollow cylindrical hub member 12 having a plurality of fluke members 14 surrounding an elongated cylindrical shank member 16 contiguous with a cylindrical and substantially right-angled bail member 18. In FIG. 1, the marine anchor 10 is shown set into the bed 20 of a body of water 22. The hub member 12 rotatably mounted on the shank 16 have each a first end (front) 24, second end (rear) 26 and a coincident longitudinal axis 28 defined therebetween. As seen in FIG. 3, a plurality of fluke members 14, spaced at equal angles about and with respect to the longitudinal axis 28 of the hub 12, extend outwardly from the surface of the hub 12 on cylindrical shafts 30, at an acute angle, toward the first end 24 of the hub 12. The base portion 32 of each fluke member 14 is preferably welded to the outside of the hub 12. Alternatively, fluke members 14 can be pivotally mounted on the hub member 12 on external brackets (not shown). Three fluke members 14 are depicted as exemplary, but four or more fluke members 14 can be accommodated to enhance the gripping power of the present invention.

The cylindrical bail member 18 is substantially right angle-shaped at the vertex 34 with a forward short leg 36 and a rear long leg 38 to accommodate positions A, B. C, and D of the bail-to-anchor chain 40 via a loose shackle ring 42. The vertex 34 is not a sharp apex but a rounded angle. The bail member 18 has a first end 24 and a second end 26. The first end 24 of the bail member 18 is fixed at the first end 24 of the elongated shank member 16. A first bail-to-anchor position A (FIGS. 1 and 2) is established when the boat is anchored and the anchor chain 40 is located at the juncture of the first ends 24 of the bail member 18 and the shank member 16.

If the anchor 10 is to be retrieved from the bed 20, the boat (not shown) is moved directly overhead to position the anchor chain 40 at position B, the vertex or the right angle portion 34 of the bail member 18. Thus, an upward pull on the anchor 10 would cause the fluke members 14 to rotate about the longitudinal axis 28 of the elongated shank 16 to effect a release of the fluke members 14 from the sea floor bed 20. Even at an intermediate position such as C proximate to the vertex 34, the anchor 10 can be extricated from a soft bed 20 by raising the anchor chain 40. If the boat is moved to the rear or second end 26 of the anchor 10 at position D, the anchor can advantageously be pulled out with a minimum of effort. The bail member 18 is free to rotate when the tension on the anchor chain 40 is further reduced to rotate to a resting position E (shown in shadow) on the surface of the bed 20 even when the fluke members 14 are entrenched in slack water. An advantage of this resting position E is that the anchor 10 offers less exposure to snagging by other errant loose anchors and clogging by debris.

It is to be understood that the present invention is not limited to the embodiments described above, but encompasses any and all embodiments within the scope of the following claims.

I claim:

1. An anchor comprising:

an elongated shank member having a first end and a second end and a longitudinal axis therebetween;

a cylindrical hub member rotatably mounted on the shank member, the hub member having a first end, a second end and a longitudinal axis therebetween, and the longitudinal axis substantially coextensive with the longitudinal axis of the shank member;

a plurality of fluke members each extending radially outward, towards the first end of the elongated shank member from the hub member at an acute angle with respect to the longitudinal axis of the hub member, and equally spaced about the perimeter of the hub member;

a bail member having a first end of a short leg attached to the first end of the shank member at an acute angle, a second end of a long leg attached to the second end of the shank member at an acute angle, and a substantially right-angled vertex formed between the short leg and the leg of the bail member; and a slidable attachment shackle attached to an anchor chain and slidable on the bail member;

whereby the slidable attachment shackle in cooperation with the bail member can be utilized for performing multiple functions in securing an anchor chain at its first end, releasing the anchor from its anchored position by forced rotation of the fluke members when the anchor chain is pulled in a position on the bail member proximate its vertex, and during slack water allowing the bail member to rest on the bottom for minimum exposure to snagging by errant anchors.

2. The anchor according to claim 1, wherein the hub member includes at least three fluke members with thin shafts for attachment of the fluke members with the hub member.

3. The anchor according to claim 1, wherein the fluke members are each shaped with a rounded end.

4. The anchor according to claim 1, wherein the fluke members are welded to the hub member.

5. The anchor of claim 1, wherein the fluke members are pivotally mounted to said hub member.

6. The anchor of claim 1, wherein the shank member and the bail members are cylindrical in cross-section.

* * * * *